US006474353B1

(12) United States Patent
Sturman et al.

(10) Patent No.: US 6,474,353 B1
(45) **Date of Patent: *Nov. 5, 2002**

(54) DOUBLE SOLENOID CONTROL VALVE THAT HAS A NEUTRAL POSITION

(75) Inventors: Oded E. Sturman; Steven Massey, both of Woodland Park, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/643,148

(22) Filed: Aug. 21, 2000

Related U.S. Application Data

(62) Division of application No. 08/828,894, filed on Mar. 28, 1997, now Pat. No. 6,105,616.

(51) Int. Cl.[7] ..... F15B 13/044
(52) U.S. Cl. ..... 137/1; 137/625.65
(58) Field of Search ..... 137/1, 625.65

(56) References Cited

U.S. PATENT DOCUMENTS

| | | | | |
|---|---|---|---|---|
| 4,319,609 A | | 3/1982 | Debrus | |
| 4,611,632 A | | 9/1986 | Kolchinsky et al. | |
| 4,741,365 A | | 5/1988 | Van Orum | |
| 5,244,002 A | | 9/1993 | Frederick | |
| 5,251,671 A | * | 10/1993 | Hiroki | 137/625.65 |
| 5,284,220 A | * | 2/1994 | Shimizu et al. | 137/625.65 X |
| 5,339,777 A | | 8/1994 | Cannon | |
| 5,460,329 A | * | 10/1995 | Sturman | 251/129.1 |
| 5,479,901 A | * | 1/1996 | Gibson et al. | 137/625.65 X |
| 5,598,871 A | | 2/1997 | Sturman et al. | |
| 5,638,781 A | * | 6/1997 | Sturman | 251/129.1 X |
| 5,640,987 A | * | 6/1997 | Sturman | 137/625.65 X |
| 5,829,396 A | | 11/1998 | Sturman et al. | |
| 6,105,616 A | | 8/2000 | Sturman et al. | |

FOREIGN PATENT DOCUMENTS

| | | |
|---|---|---|
| DE | 2209206 | 8/1973 |

* cited by examiner

*Primary Examiner*—Gerald A. Michalsky
(74) *Attorney, Agent, or Firm*—Blakely, Sokoloff, Taylor & Zafman LLP

(57) ABSTRACT

A three position digitally latched actuator actuated fluid control valve. The control valve includes a housing which has a cylinder port, a supply port and a return port. The control valve also contains an internal valve that moves between a first position, a second position and a neutral position. In the first position the internal valve provides fluid communication between the cylinder port and the supply port. In the second position the valve provides fluid communication between the cylinder port and the return port. In the neutral position the valve prevents fluid communication between the ports. The control valve has a first actuator and a second actuator that are actuated by digital pulses to move the internal valve between the first, second and neutral positions. The control valve may have a pair of springs that bias the internal valve to the neutral position, wherein the actuator can be actuated to latch the valve into the first position and the second actuator can be actuated to latch the valve into the second position.

16 Claims, 4 Drawing Sheets

DOUBLE SOLENOID CONTROL VALVE THAT HAS A NEUTRAL POSITION

CROSS-REFERENCE TO RELATED APPLICATIONS

This application is a divisional of application Ser. No. 08/828,894 filed Mar. 28, 1997, now U.S. Pat. No. 6,105,616.

BACKGROUND OF THE INVENTION

1. Field of the Invention

The present invention relates to a fluid control valve.

2. Description of Related Art

Hydraulic systems are commonly utilized in various vehicles, machines and equipment because of the mechanical advantage provided by hydraulic power. Most hydraulic systems contain a number of fluid control valves that control the actuation of the machine. The control valves typically switch states in response to an input command. The input command may be the rotation of a simple mechanical lever that moves an internal valve, or an electrical current which energizes a actuator and moves the internal valve. Actuator actuated valves can be coupled to a controller that can control the state of the valve and the actuation of the machine.

There are a number of different actuator actuated control valves. By way of example, there exist two-way valves, three-way valves, and four-way valves. A two-way valve includes two external ports and an internal valve which controls the flow of fluid through the valve. The internal valve is moved between two extreme positions. In one position the internal valve allows fluid communication between the ports. In the other position the internal valve prevents fluid communication between the ports. Two-way valves can provide an "on-off" switch for an hydraulic system.

Three-way valves contain a cylinder port, a supply port and a return port. Like the two-way valve, three-way valves contain an internal valve that moves between two extreme positions. In one position the internal valve couples the cylinder port to the supply port. In the other position the internal valve couples the cylinder port to the return port. Four-way valves have an additional second cylinder port and are constructed so that the first cylinder port is coupled to the supply port and the second cylinder port is coupled to the return port when the internal valve is in a first position. In the second valve position the first cylinder port is connected to the return port and the second cylinder port is connected to the supply port. By way of example, three-way control valves are used to control a spring return hydraulic piston. Four-way valves are used to control an hydraulic piston that does not have a spring return.

All three types of actuator actuated control valves have limitations on use within an hydraulic system. Two-way valves can only provide on and off functions. Three-way and four-way valves cannot be used to maintain a machine in an intermediate position. For example, when coupled to an hydraulic piston, three-way and four-way valves always couple the cylinder port(s) to either the supply or return lines. The piston is thus either fully extended or fully retracted. The system would require an additional two-way valve to maintain the piston at a location between the retracted and extended positions. It would be desirable to provide a actuator actuated control valve that has three positions.

SUMMARY OF THE INVENTION

The present invention is a three position digitally latched actuator actuated fluid control valve. The control valve includes a housing which has a cylinder port, a supply port and a return port. The control valve also contains an internal valve that moves between a first position, a second position and a neutral position. In the first position the internal valve provides fluid communication between the cylinder port and the supply port. In the second position the valve provides fluid communication between the cylinder port and the return port. In the neutral position the valve prevents fluid communication between the ports. The control valve has a first actuator and a second actuator that are actuated by digital pulses to move the internal valve between the first, second and neutral positions. The control valve may have a pair of springs that bias the internal valve to the neutral position, wherein the actuator can be actuated to latch the valve into the first position and the second actuator can be actuated to latch the valve into the second position.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
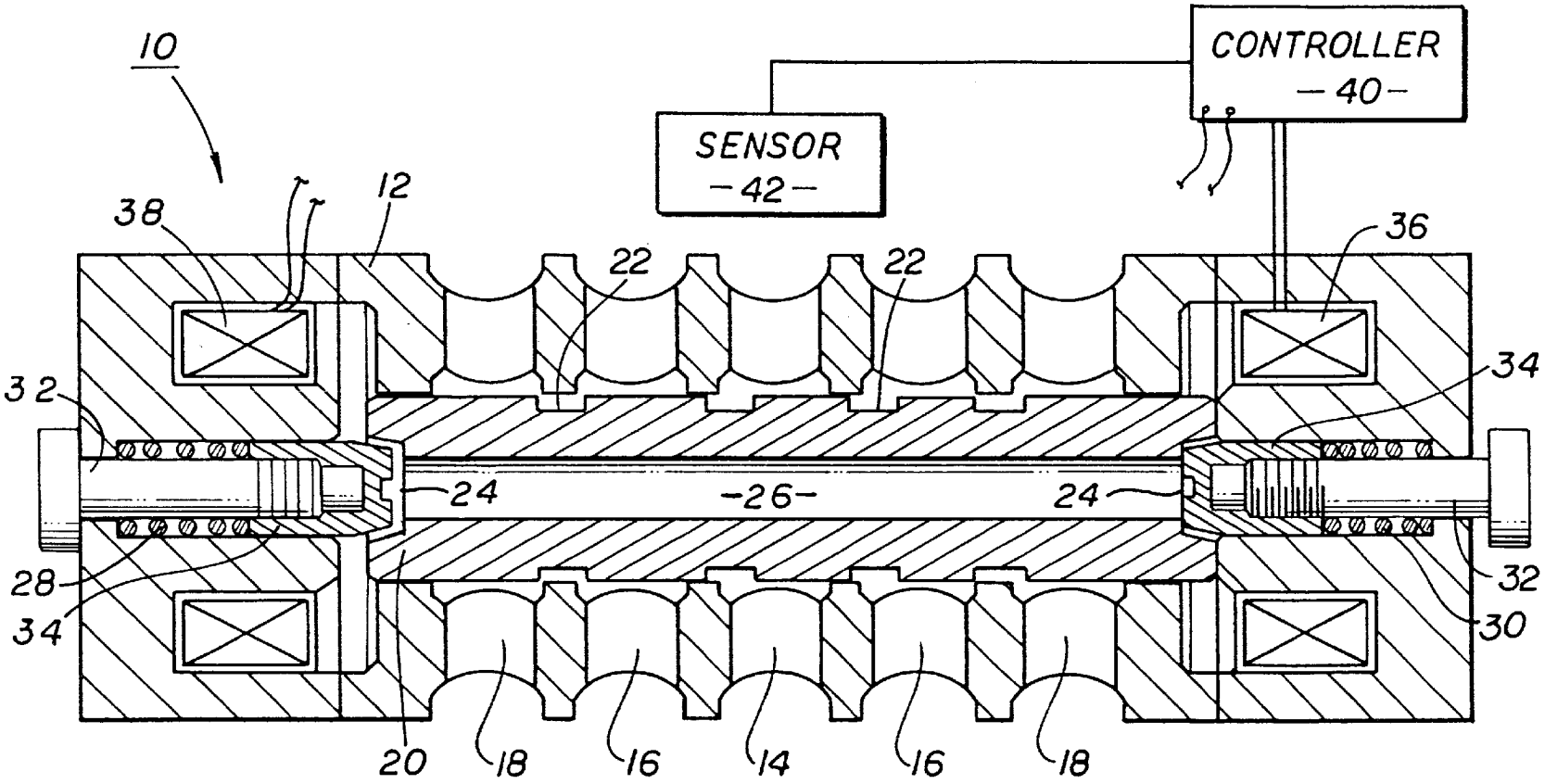
FIG. 1 is a cross-sectional view of a control valve of the present invention in a first position.

Referring to the drawings more particularly by reference numbers, FIG. 1 shows a fluid control valve 10 of the present invention. The control valve 10 includes a housing 12 which has a return port 14, a pair of cylinder ports 16 and a pair of supply ports 18. The supply ports 18 are typically connected to a pressurized fluid line of an hydraulic system. The return port 14 is typically connected to a drain line of the system. The cylinder ports 16 are typically connected to a mechanism such as an hydraulic piston, a fuel injector or an intake/exhaust valve of an internal combustion engine. Although a three-way valve is shown and described it is to be understood that the control valve 10 may be a four-way valve.

The control valve 10 has an internal spool valve 20 that controls the flow of fluid through the ports 14, 16 and 18. The spool 20 contains a plurality of grooves 22 that can allow fluid to flow between adjacent ports. The spool 20 is moved between a first position, a second position and a neutral position.

In the first position the spool 20 allows fluid communication between the cylinder ports 16 and the supply ports 18, and prevents fluid communication between the cylinder ports 16 and the return port 14. In the second position the spool 20 allows fluid communication between the cylinder ports 16 and the return port 14 and prevent fluid communication between the cylinder ports 16 and the supply ports 18. In the neutral position the spool 20 prevents fluid communication between any port 14, 16 or 18.

The cylinder ports 16 and supply ports 18 are preferably located on opposite sides of the return port 14 so that the valve is dynamically balanced when the spool 20 is in the first or second positions. Additionally, the spool 20 preferably contains a pair of outer end openings 24 that are connected by an inner channel 26. The openings 24 and channel 26 prevent fluid from being trapped between the ends of the spool 20 and the housing 12 and exerting a counteracting static force on the spool 20.

The spool 20 is biased into the neutral position by a first spring 28 and a second spring 30. The springs 28 and 30 are captured by the housing 12 and a pair of needles 32. Each needle 32 has an outer sleeve 34 that engages the end of the spool 20.

The control valve 10 includes a first actuator 36 and a second actuator 38 that move the spool 20 between the first, second and third positions. The actuators 36 and 38 are connected to a controller 40. The housing 12 and spool 20 are preferably constructed from a magnetic steel material which will retain enough magnetism to maintain the position of the spool 20 in the first or second positions even when power to the actuators is terminated. Such a construction allows the controller 40 to latch the spool 20 into the first or second positions by providing a digital pulse to one of the actuators 36 or 38. The present invention thus provides a three position digitally latched double actuator actuated control valve 10.

Figure 2:
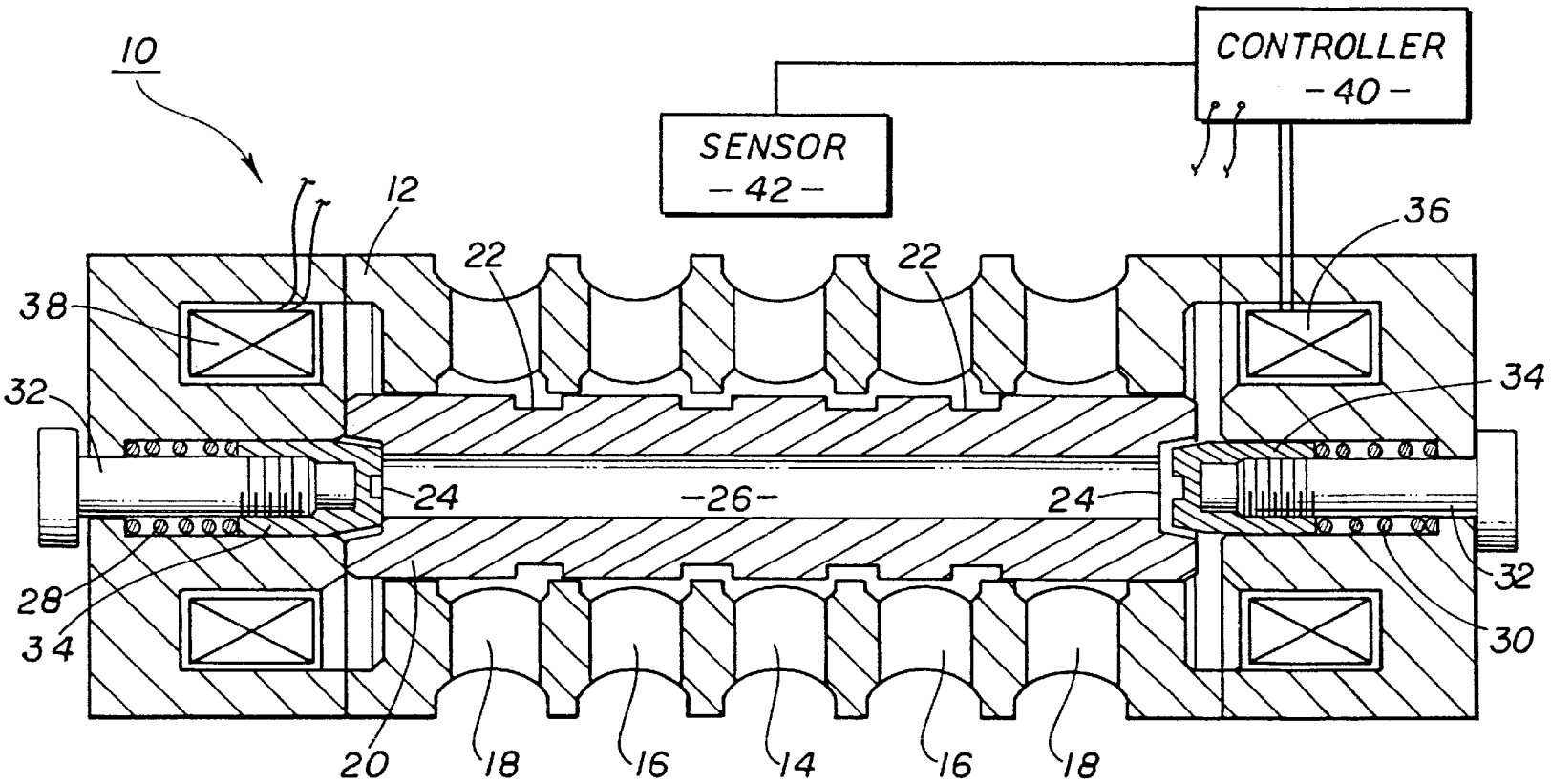
FIG. 2 is a cross-sectional view of the control valve in a second position.

In operation, as shown in FIG. 1, the spool 20 may be initially in the first position, such that fluid flows from the supply ports 18 to the cylinder ports 16. To couple the cylinder ports 16 to the return port 14 the controller 40 provides a digital pulse to the second actuator 38. As shown in FIG. 2, the energized second actuator 38 pulls the spool 20 into the second position.

Figure 3:
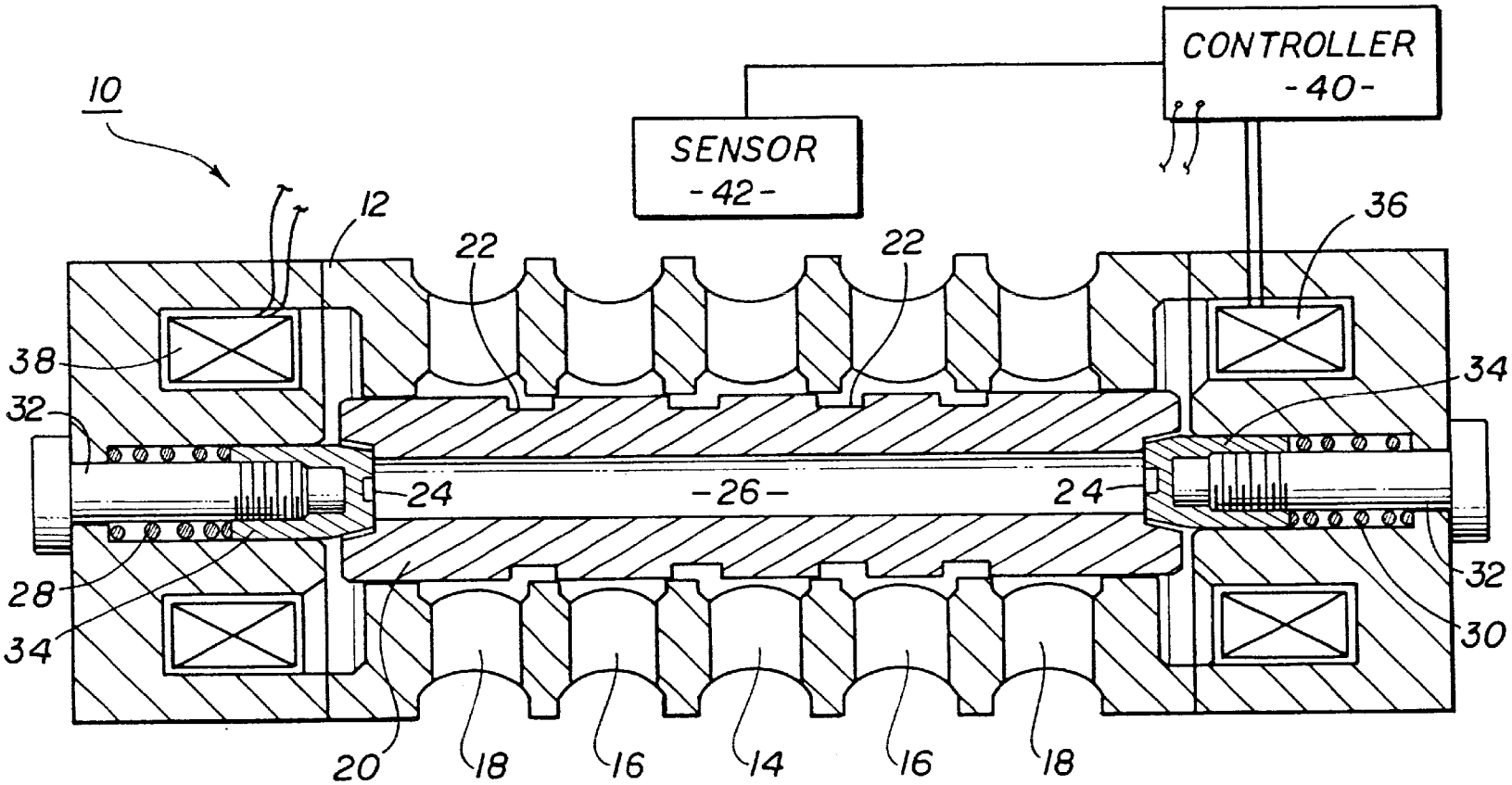
FIG. 3 is a cross-sectional view of the control valve in a neutral position.

As shown in FIG. 3, the spool 20 can be moved to the neutral position to block all fluid flow through the valve 10. The spool 20 may be moved to the neutral position by providing enough energy to the first actuator 36 to detach the spool from the second actuator 38. The energy provided to the first actuator 36 is too small to latch the spool 20 to the actuator 36, so that the springs 28 and 30 return the spool 20 to the neutral position. Alternatively, energy may be provided to the second actuator 38 to push the spool 20 away from the actuator 38.

The controller 40 may also provide digital signal to the first and second actuators to iteratively move the spool 20 to the neutral position. The valve 10 may have a position sensor 42, such as a Hall sensor, which senses the position of the spool 20 within the housing 12. The controller 40 can provide digital pulses to the actuators 36 and 38 until the position sensor 42 senses that the spool 20 is in the neutral position.

Figure 4:
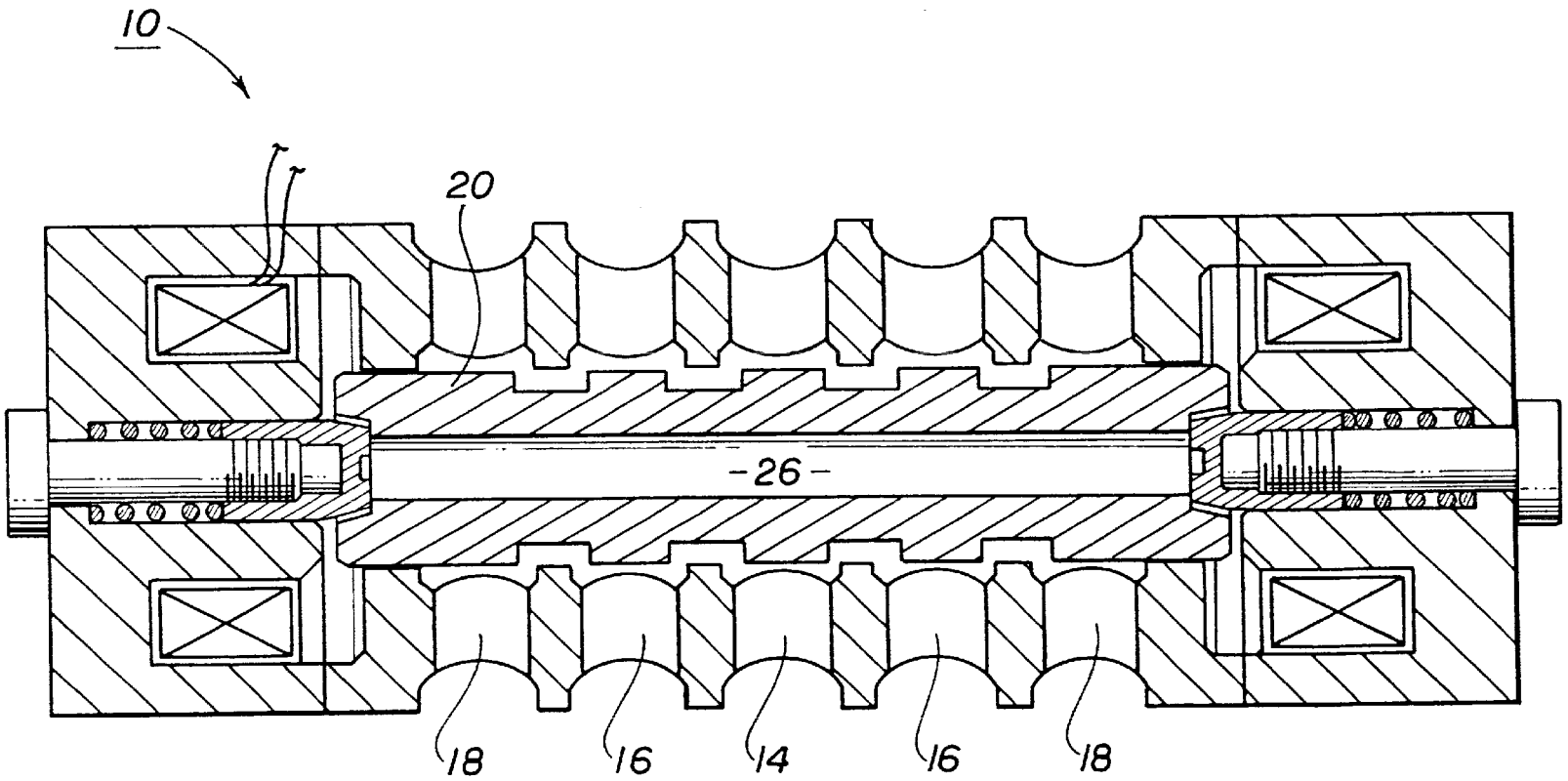
FIG. 4 is a cross-sectional view of an alternate embodiment of the control valve.

FIG. 4 shows an alternate embodiment, wherein the spool 20 allows fluid communication between all of the ports 14, 16 and 18 when in the neutral position.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A fluid control valve, comprising:

a housing defining a valve bore, the valve bore including a first port, a second port, a third port, and a first and a second opposing valve bore ends;

a first and a second needle, each needle adjacent one of the valve bore ends;

a first and a second spring, each spring captured by the housing and one of the needles;

a first ad a second outer sleeve, each outer sleeve coupled to one of the needles such that one of the springs urges the outer sleeve toward the opposing outer sleeve and the needle limits the motion of the outer sleeve toward the opposing outer sleeve; and a valve spool located within the valve bore between the first and second outer sleeves, the valve spool having a first and a second opposing spool end, the valve spool being movable between a neutral position wherein the first spool end engages the first outer sleeve at the limit of motion of the first outer sleeve and the second spool end engages the second outer sleeve at the limit of motion of the second outer sleeve, a first position wherein the first spool end is adjacent the first valve bore end, engages the first outer sleeve, and compresses the first spring, and a second position wherein the second spool end is adjacent the second valve bore end, engages the second outer sleeve, and compresses the second spring.

2. The fluid control valve of claim 1, further comprising:

a first actuator operable to move the valve spool to the first position: and a second actuator operable to move the valve spool to the second position.

3. The fluid control valve of claim 2, wherein the housing and the valve spool are constructed from a material with enough residual magnetism to maintain the valve spool in one of the first position and second position when the first and second actuators are de-energized and allows the valve spool to return to the neutral position when one of the one of the first and second actuators is energized.

4. The fluid control valve of claim 1, wherein the fluid control valve has a position sensor to sense the position of the valve spool within the housing.

5. The fluid control valve of claim 4, wherein the position sensor is a Hall effect sensor.

6. The fluid control valve of claim 1, further comprising:

a first actuator operable to latch the valve spool in the first position; and a second actuator operable to latch the valve spool in the second position.

7. The fluid control valve of claim 6, further comprising:

a controller electrically coupled to the first and second actuators, to provide a first digital pulse to the first actuator to move the valve spool away from the neutral position and toward the first position, and to provide a second digital pulse to the second actuator to move the valve spool away from the neutral position and toward the second position.

8. The fluid control valve of claim 7, wherein the controller is further to provide a third digital pulse to the first actuator to move the valve spool away from the second position and toward the neutral position, and to provide a fourth digital pulse to the second actuator to move the valve spool away from the first position and toward the neutral position.

9. The fluid control valve of claim 8, wherein the fluid control valve further comprises a position sensor to sense the position of the valve spool within the housing and the controller further provides at least one of the third digital pulse and the fourth digital pulse until the position sensor senses that the valve spool is in the neutral position.

10. The fluid control valve of claim 7, wherein the controller is further to provide a third digital pulse to the first actuator to move the valve spool away from the first position and toward the neutral position, and to provide a fourth digital pulse to the second actuator to move the valve spool away from the second position and toward the neutral position.

11. The fluid control valve of claim 10, wherein the fluid control valve further comprises a position sensor to sense the position of the valve spool within the housing and the controller further provides at least one of the third digital pulse and the fourth digital pulse until the position sensor senses that the valve spool is in the neutral position.

12. The fluid control valve of claim 1, wherein the first port is arranged in fluid communication with the second port when the valve spool is in the first position, the first port is arranged in fluid communication with the third port when the valve spool is in the second position, and fluid communication is blocked between the first port, the second port, and the third port when the valve spool is in the neutral position.

13. The fluid control valve of claim 1, wherein the first port is arranged in fluid communication with the second port when the valve spool is in the first position, the first port is arranged in fluid communication with the third port when the valve spool is in the second position, and the first port, the second port, and the third port fluid communication are arranged in fluid communication with one another when the valve spool is in the neutral position.

14. The fluid control valve of claim 1, wherein the housing further has a fourth port.

15. The fluid control valve of claim 14, wherein the first port is arranged in fluid communication with the second port and the third port is arranged in fluid communication with the fourth port when the valve spool is in the first position, the first port is arranged in fluid communication with the fourth port and the third port is arranged in fluid communication with the second port when the valve spool is in the second position, and fluid communication is blocked between the first port, the second port, the third port, and the fourth port when the valve spool is in the neutral position.

16. The fluid control valve of claim 14, wherein the first port is arranged in fluid communication with the second port and the third port is arranged in fluid communication with the fourth port when the valve spool is in the first position, the first port is arranged in fluid communication with the fourth port and the third port is arranged in fluid communication with the second port when the valve spool is in the second position, and the second port, the third port, and the fourth port are arranged in fluid communication with one another when the valve spool is in the neutral position.

* * * * *